US006533403B2

(12) United States Patent
Hou et al.

(10) Patent No.: US 6,533,403 B2
(45) Date of Patent: Mar. 18, 2003

(54) INK RESERVOIR WITH A PRESSURE ADJUSTING DEVICE

(75) Inventors: I-Chung Hou, Hsin-Chu (TW); Cheng-Wei Hsu, Yung-Kang (TW)

(73) Assignee: International United Technology Co., Ltd., Chu-Pei (TW)

( * ) Notice: Subject to any disclaimer, the term of this patent is extended or adjusted under 35 U.S.C. 154(b) by 0 days.

(21) Appl. No.: 09/683,458

(22) Filed: Jan. 3, 2002

(65) Prior Publication Data

US 2002/0044182 A1 Apr. 18, 2002

(30) Foreign Application Priority Data

Jan. 8, 2001 (TW) ..... 90100380 A

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS

| | | | | |
|---|---|---|---|---|
| 5,453,772 A | * | 9/1995 | Aono et al. | 347/87 |
| 6,186,620 B1 | * | 2/2001 | Hsieh et al. | 347/84 |
| 6,203,146 B1 | * | 3/2001 | Pawlowksi, Jr. et al. | 347/85 |
| 6,213,598 B1 | * | 4/2001 | Hou et al. | 347/86 |
| 2002/0047883 A1 | | 4/2002 | Hou et al. | 347/86 |

* cited by examiner

*Primary Examiner*—Anh T. N. Vo
(74) *Attorney, Agent, or Firm*—Winston Hsu

(57) ABSTRACT

An ink reservoir has an air bag, a housing with an ink reservoir, an elastic constraining device for constraining the air bag to prevent the seepage of ink by way of back-pressure, an active shaft movably installed in the ink reservoir, and a plugging device engaged with the active shaft for plugging a second vent of the housing. When consumption of ink in the ink reservoir causes the air bag to expand to a predetermined degree, the air bag moves the active shaft, the active shaft pulls the plugging device out of the second vent, and air enters into the ink reservoir to reduce the volume of the air bag.

18 Claims, 5 Drawing Sheets

INK RESERVOIR WITH A PRESSURE ADJUSTING DEVICE

BACKGROUND OF INVENTION

1. Field of the Invention

The present invention relates to a pressure adjusting device, and more particularly, to a pressure adjusting device for controlling the pressure within the ink reservoir of an ink-jet print cartridge.

2. Description of the Prior Art

With the increasing in popularity of personal computers, and a correspondingly increasing demand for personal image output, ink-jet printing devices have become the most common computer output/printing devices for individuals, families, and companies. Such devices offer a price and printing quality that is attractive for users. Ink-jet printing generally relies on the controlled delivery of ink droplets from an ink-jet print cartridge ink reservoir to a print medium. Among the printing methods for delivering these ink droplets from the ink reservoir to the print head, drop-on-demand printing is a commonly used method. The drop-on-demand method typically uses thermal bubbles or piezo-electric pressure wave mechanisms. The thermal bubble type print head comprises a thin-film resistor that is heated to cause sudden vaporization of a small portion of the ink. The vapid expansion of the ink vapor forces a small droplet of ink through a print head nozzle. Although drop-on-demand printing is ideal for sending ink droplets from an ink reservoir to the print head, some mechanisms must be included to prevent ink from leaking out of the print head while the print head is inactive. This kind of controlling mechanism usually provides a slight back-pressure at the print head to prevent ink from leaking out from the print head whenever the print head is inactive. The term "back-pressure" indicates a partial vacuum within the ink reservoir. The back-pressure is defined in a positive sense so that increasing the back-pressure means that the degree of partial vacuum has increased within the ink reservoir.

Although increasing the back-pressure can prevent ink from leaking out from the print head, the back pressure must not be so high that the print head can not overcome the back-pressure to eject ink droplets. Furthermore, as ambient air pressure decreases, the necessary back pressure that prevents ink from leaking out from the print head needs to be correspondingly larger. Accordingly, back-pressure within the ink-jet print cartridge has to be regulated whenever the ambient pressure drops. Also, the pressure within the ink reservoir is subjected to what may be termed "operational effects". This refers to the depletion of ink from the ink reservoir, which tends to increase the back-pressure within the ink reservoir. Unless the back-pressure is regulated properly, the print head will eventually fail because the back-pressure becomes too great for the print to overcome.

In the prior art, a "regulator" in the ink reservoir controls the reservoir back-pressure. The regulator is usually an elastic air bag, and the elastic air bag typically connects to the external atmosphere via a vent. When ink is consumed, for example, ambient air will enter into the elastic air bag through the vent so that the volume of the elastic air bag increases to decrease the reservoir volume, and so reduce the back-pressure to a value that is within the operational range of the print head. Another example can be found in a drop of ambient pressure. In such cases, the volume of the elastic air bag changes to increase the reservoir volume to thereby increase the back-pressure to a level that prevents ink leakage from the print head.

A major shortcoming of the prior art elastic-air-bag regulator is a limitation in a maximum volume of the elastic air bag. As ink is gradually jetted from the print head, the elastic air bag will eventually reach its maximum extent, and the reservoir volume can therefore not be adjusted further. The continuous reduction of ink volume in the reservoir causes the back-pressure to exceed the operational back-pressure range. When this occurs, the print head can no longer overcome the back-pressure to eject ink from the print head, and the remaining ink within the ink reservoir cannot be used completely and so is wasted.

Another type of prior art that is used to control the back-pressure within an ink reservoir is a bubble generator. As disclosed in U.S. Pat. No 5,526,030, which is included herein by reference, the bubble generator is set in the ink reservoir and has an orifice through which ambient air can enter the reservoir. The dimensions of the orifice, when designed appropriately, cause ink to gather in the orifice to seal off the reservoir by way of capillary effects. When the back-pressure within the ink reservoir rises to a predetermined degree, external air overcomes the liquid seal and enters into the ink reservoir as a bubble. Thus, the back-pressure within the ink reservoir decreases. Additionally, when the bubble enters into the ink reservoir, capillary effects again take over and re-establish the liquid seal to prevent bubbles from continuously entering. However, the bubble generator described above uses surface the tension of the ink and static pressure of the ink column to control bubbles entering the ink reservoir. Therefore, the primary shortcomings of the prior art described above are: 1. Different inks have different surface tensions, and so the bubble generator needs to be redesigned for various types of ink; 2. As the level of ink within the reservoir gradually drops, the static pressure of the ink column decreases, leading to the entrance of air bubbles at smaller back pressures; 3. The gap between the sphere and the orifice has to be precisely engineered to permit the entrance of air bubbles at the correct reservoir back-pressure. This increases difficulties in fabricating the reservoir of an ink-jet cartridge.

SUMMARY OF INVENTION

It is therefore a primary objective of the present invention to provide a pressure adjusting device capable of controlling the pressure within the ink reservoir of an inkjet cartridge.

Another objective of the present invention is to provide a simple and reliable pressure adjusting device.

According to claimed invention, an ink-jet cartridge comprises an ink reservoir for storing ink. The reservoir has a first vent, a second vent, and an opening. The opening is installed at a bottom end of the reservoir and is connected to the print head. An air bag is installed within the ink reservoir and connected to the first vent. The first vent enables external air to enter into the air bag, enabling the air bag to adjust internal pressure within the ink reservoir. An elastic constraining device is installed in the ink reservoir for constraining air in the air bag, and so to prevent the ink in the ink reservoir from leaking through the opening. An active shaft is movably installed in the ink reservoir. A plugging device engages with the active shaft to plug the second vent of the housing. Consumption of the ink within the ink reservoir causes the air bag to expand. When the air bag expands to a predetermined degree, the air bag moves the active shaft, the active shaft pulls the plugging device out of the second vent, and air enters into the ink reservoir through the second vent to reduce the volume of the air bag. When the air bag steps moving the active shaft, the active shaft returns to an original position and the plugging device plugs the second vent again.

It is an advantage of the present invention that the pressure adjusting device can adjust internal pressure within the ink reservoir.

It is a further advantage of the present invention that the structure is simple and reliable. Even if ambient air pressure changes, it still works normally and isn't affected by operational effects of the ink reservoir.

These and other objectives and advantages of the present invention will no doubt become obvious to those of ordinary skill in the art after having read the following detailed description of the preferred embodiment that is illustrated in the various figures and drawings.

DETAILED DESCRIPTION

Figure 1:
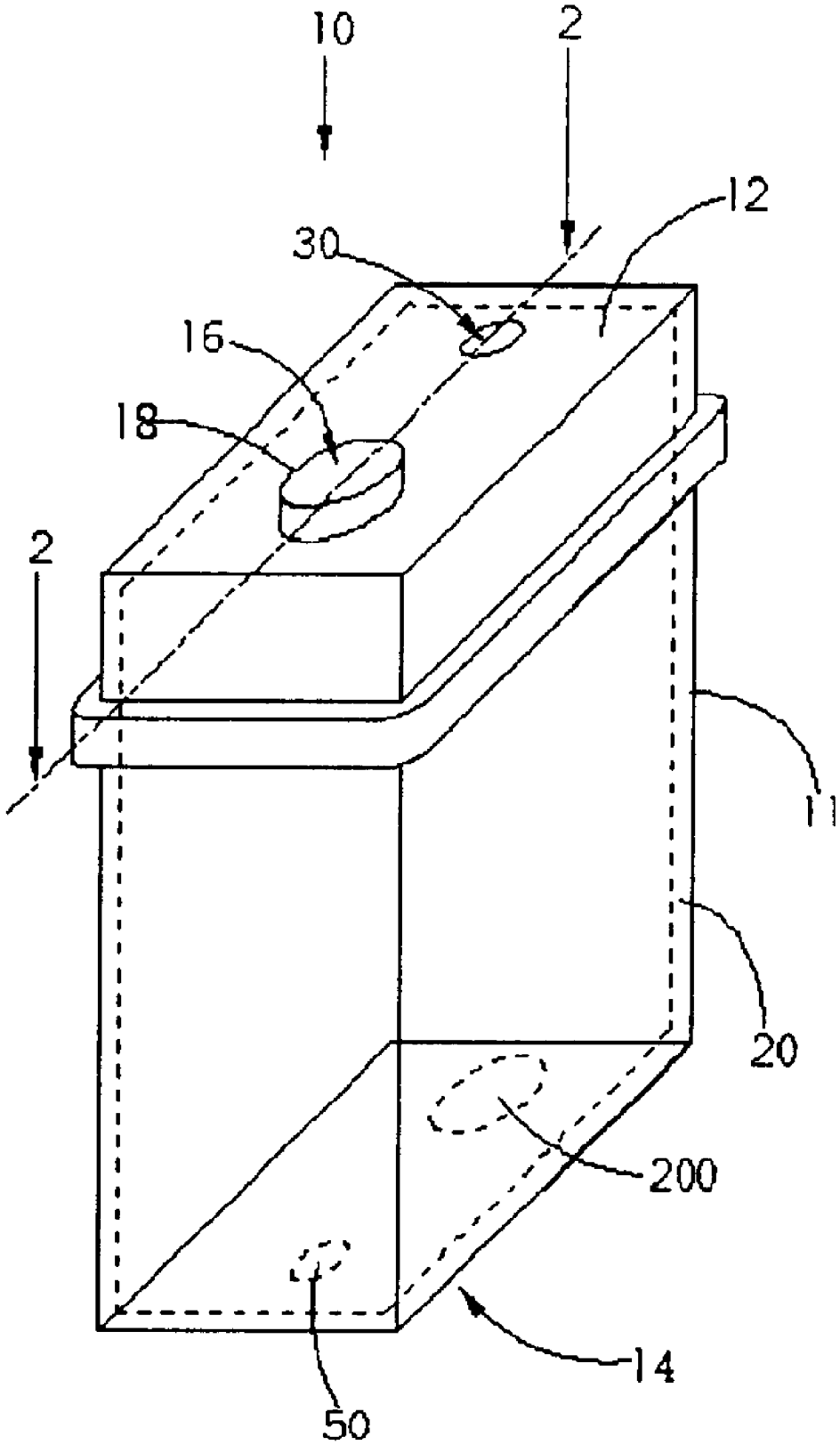
FIG. 1 is a perspective view of a present invention ink cartridge.

Please refer to FIG. 1. FIG. 1 is a perspective view of a present invention ink reservoir 20. The ink reservoir 20 comprises a housing 11 within which is stored ink. A top 12 of the housing 11 has a first vent 30, and a fill opening 16. A bottom 14 of the housing 11 has a second vent 50 and an ink-access opening 200. Ink is poured into the ink reservoir 20 through the fill opening 16. When the ink reservoir 20 is full, a seal cap 18 is used to seal the fill opening 16. The ink reservoir 20 delivers ink through the ink-access opening 200. An ink jet print head (not shown) is attached to the ink-access opening 200, as well as circuitry (not shown) related to the ink jet print head. The circuitry controls the ink-jet print head when jetting ink to perform a printing operation.

Figure 2:
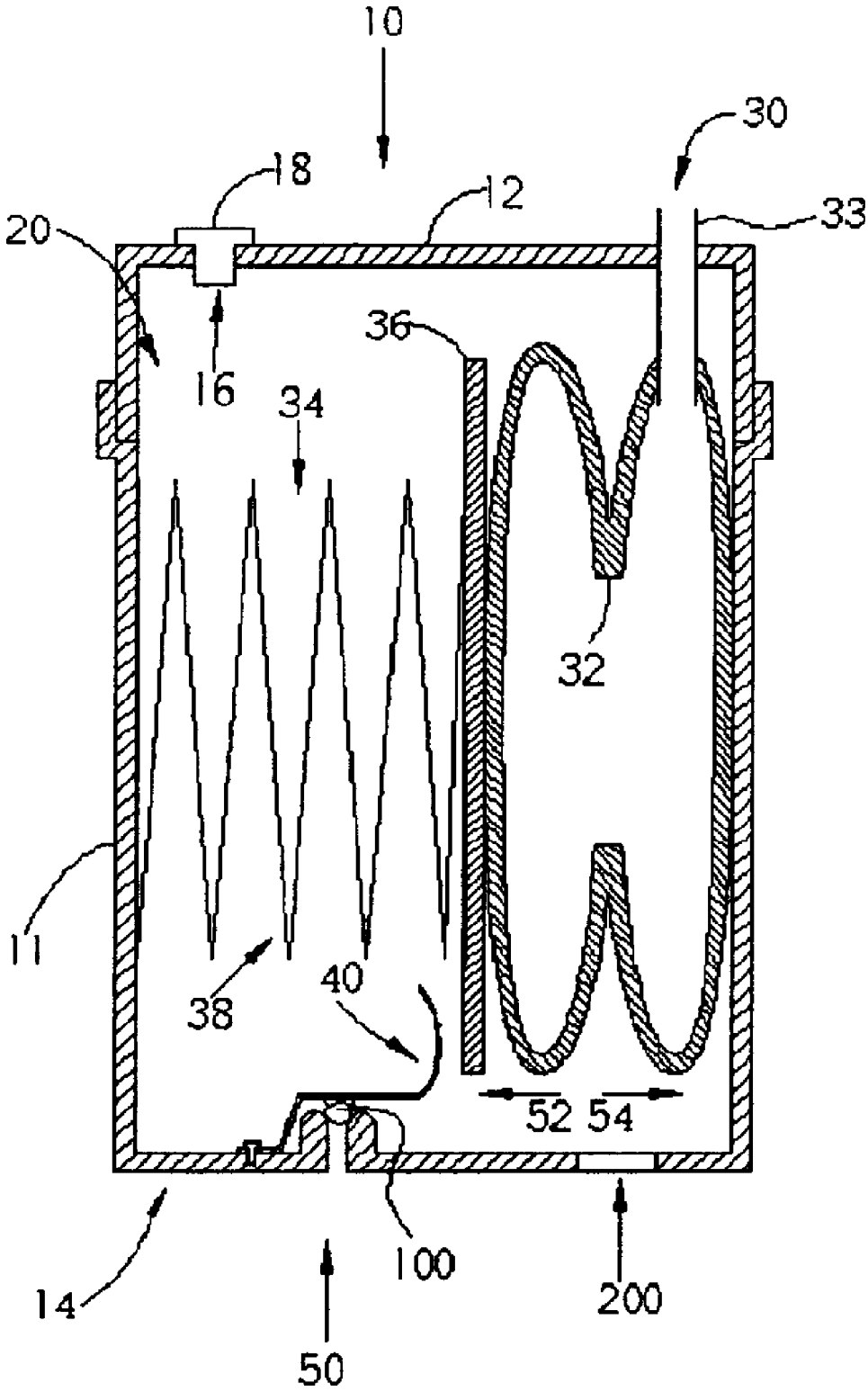
FIG. 2 is a cross-sectional diagram of a present invention ink reservoir along a line 2—2 of FIG. 1.

Please refer to FIG. 2. FIG. 2 is a cross-sectional diagram of the ink reservoir 20 along the line 2—2 shown in FIG. 1. As above, the ink reservoir 20 is used to store ink and to provide ink through the ink-access opening 200. To prevent ink leaking from the ink-access opening 200, the ink reservoir 20 must remain within a predetermined back-pressure range. As mentioned above, although there are several prior art mechanisms to maintain back-pressure, such mechanisms have shortcomings. Therefore, to overcome the shortcomings of these prior art mechanisms, the present invention ink reservoir 20 uses a new back-pressure controlling mechanism. The back-pressure controlling mechanism uses an air bag 32, an elastic constraining device 34, an active shaft 40, and a plugging device 100, all of which are within the ink reservoir 20. The air bag 32 is a sealed hollow bag so as to be isolated from fluid in the ink reservoir 20. The air bag 32 connects to the first vent 30 on the top 12 of the housing 11 by way of a ventilation pipe, and external air passes in and out of the air bag 32 through the first vent 30 via the ventilation pipe. The elastic constraining device 34 comprises a press board 36 and a spring 38. One end of the spring 38 is fixed on a wall of the housing 11, and the other is fixed on the press board 36, so that the spring 38 applies pressure to the air bag 32 through the press board 36. The active shaft 40 is fixed on the bottom of the housing 14, and is an elastic element.

Figure 3:
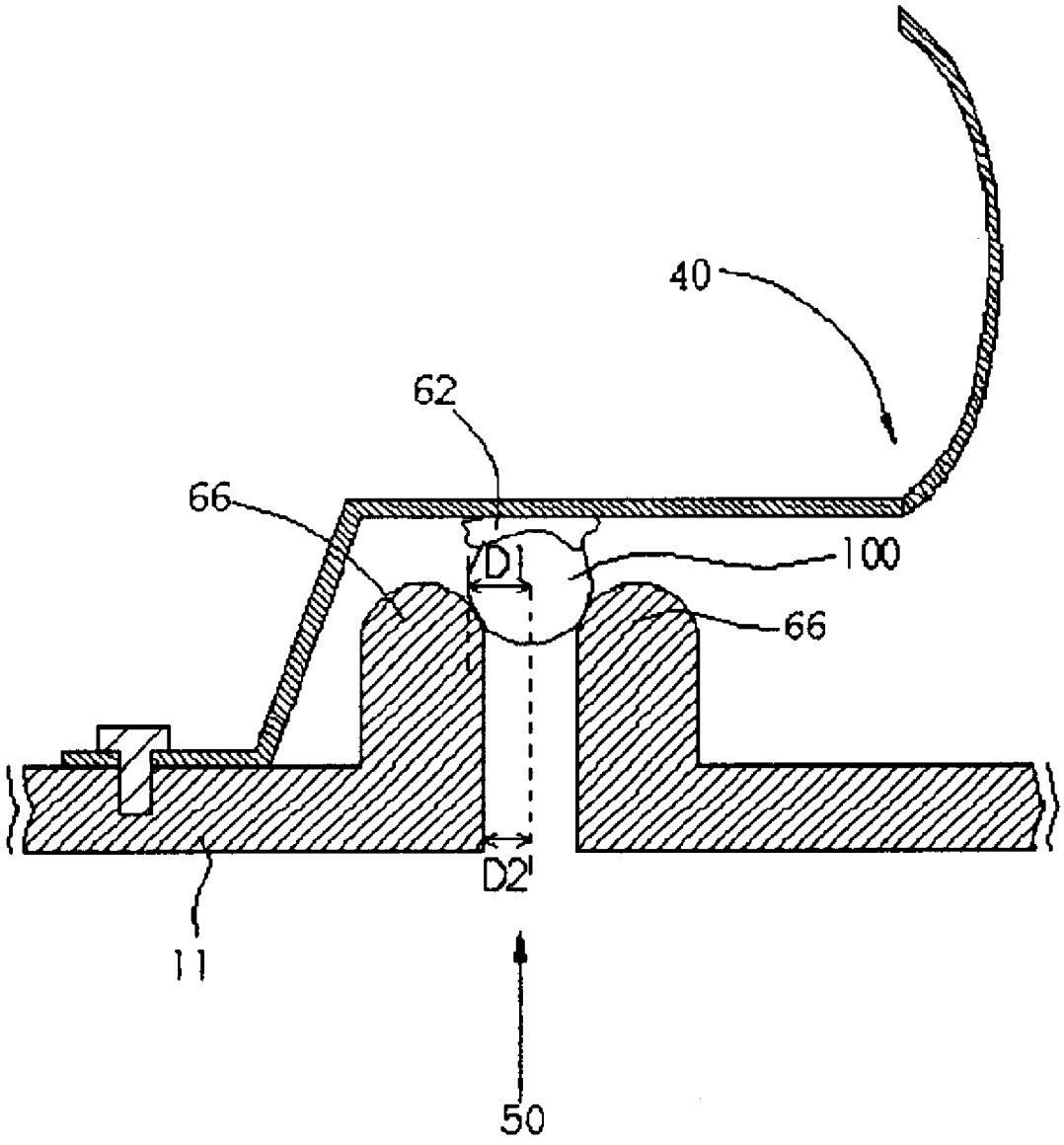
FIG. 3 is a detailed side view of an active shaft and plugging device shown in FIG. 2.

Please refer to FIG. 3. FIG. 3 is a detailed structural diagram of the active shaft 40 and the plugging device 100 shown in FIG. 2. The active shaft 40 is set in the ink reservoir 20 on the bottom of the housing 14. An adhesive 62 is used to attach the plugging device 100 to a side of the active shaft 40 so that the plugging device 100 is engaged with the active shaft 40. The plugging device 100 is used to plug the second vent 50 to prevent external air from entering into the ink reservoir 20 through the second vent 50. As mentioned above, the active shaft 40 is an elastic element, so the active shaft 40 elastically pushes the plugging device 100 towards the second vent 50. In this manner, the plugging 100 contacts an upper edge of the second vent 50 and so plugs the second vent 50. As shown in FIG. 3, the plugging device 100 has a spherical shape, with a radius of D1. The second vent 50 has a round cross section, with a radius of D2. D1 is greater than D2. The plugging device 100, therefore, plugs the second vent 50 so that external air cannot enter into the ink reservoir 20 through the second vent 50 when the plugging device 100 is in contact with the upper edge of the second vent 50.

As mentioned above, the ink reservoir 20 must maintain a predetermined back-pressure to ensure that the print head works properly. The working principle of regulating back-pressure in the present invention ink reservoir 20 is described in the following. As shown in FIG. 2, when the ink reservoir 20 is initially filled with ink, the air bag 32 is pressed to a right wall of the ink reservoir 20 along a second direction 54 (as shown, to the right) by the press board 36 due to the spring 38. The press board 36 does not contact the active shaft 40 at this point. When ink within the ink reservoir 20 is provided to the print head (not shown) through the ink-access opening 200, the air bag 32 imports external air through the first vent 30 and expands. As the air bag 32 expands along a first direction 52 (as shown, to the left), the spring 38 continues to increase pressure along the second direction 54 upon the air bag 32 through the press board 36. The volume of the ink reservoir 20 thus reduces as the air bag 32 expands, keeping the reservoir back-pressure within an adequate level such that the print head is able to continue ejecting ink from the reservoir 20.

Figure 4:
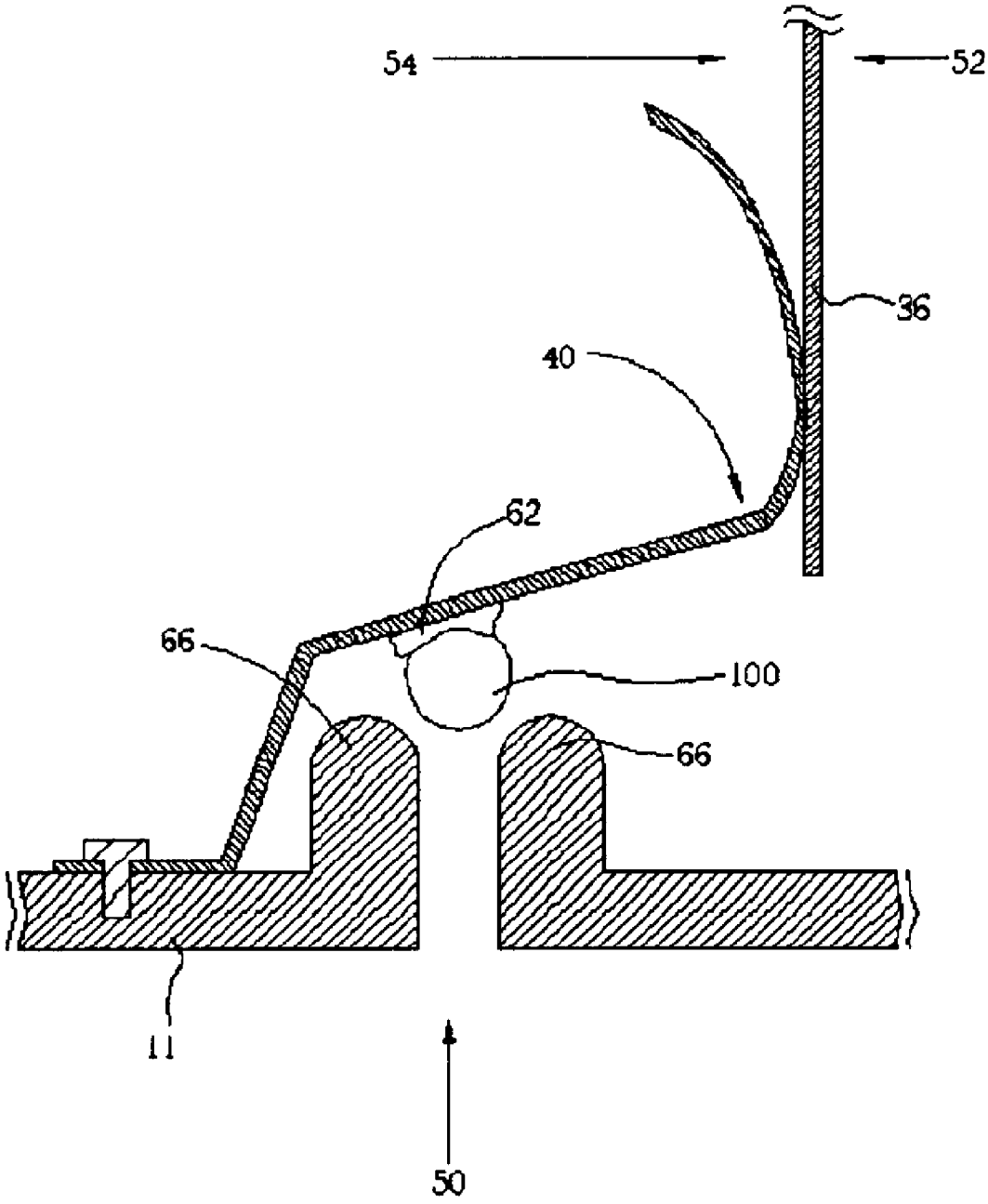
FIG. 4 is a detailed side view of the plugging device of FIG. 3 when pulled out by the active shaft shown.

Please refer to FIG. 4. FIG. 4 is a diagram of the plugging device 100 when pulled out of the second vent 50 by the active shaft 40 shown in FIG. 2. As mentioned above, as the ink in the ink reservoir 20 is consumed, the air bag 32 expands along a first direction 52, and the press board 36 is simultaneously pushed by the air bag 32 towards the left of the diagram (direction 52). When the air bag 32 expands to a predetermined degree, as shown in FIG. 4, the press board 36 contacts and pushes the active shaft 40. At this time, the active shaft 40 is pushed upward because of the force upon the active shaft 40 by the press board 36 along the first direction 52, and the active shaft 40 pulls the plugging device 100 from the top of the second vent 50. When the plugging device 100 is pulled out of the second vent 50 by the active shaft 40, the plugging device 100 and an arc-shaped lip 66 of the second vent 50 are no longer in contact with each other, thus form an opening through which external air can enter. At this time, external air enters into the ink reservoir 20 through the second vent 50. With external air entering into the ink reservoir 20, the fluid pressure within the ink reservoir 20 (i.e. the total pressure of air and ink in the ink reservoir) increases. The difference between internal and external pressure of the ink reservoir 20 thus reduces, and so back-pressure within the ink reservoir 20 reduces. The force resisting expansion of the air bag 32 on the press board 36 strengthens. Finally, the force acting on the press board 36 and resisting the expansion of the air bag 32 exceeds the expanding force of the air bag 32 along the first direction 52, so that the press board 36 is pushed to the right (direction 54) and disengages from the active shaft 40. With the force that the press board 36 applies on the active shaft 40 no longer present, the active shaft 40 returns to an original position because of its elasticity and pushes the plugging device 100 towards the second vent 50. The plugging device 100 thus once again plugs the second vent 50. Of course, as the air bag 32 expands to a predetermined degree with the consumption of ink, the above process of opening/closing the second vent 50 happens repeatedly until the ink supply is exhausted. Therefore, a primary objective of the present invention ink reservoir 20 is for the air bag 32 to push on the active shaft 40 by way of the press board 36 due to expansion. When this happens, the active shaft 40 pulls the plugging device 100 from the second vent 50 to permit external air to flow into the ink reservoir 20, and thus keep the back-pressure in the ink reservoir 20 within an adequate range until the ink is finally exhausted.

As shown in FIG. 3, the housing 11 forms a lip 66 around the top of the second vent 50. A surface of the lip 66 and a surface of the plugging device 100 meet at a special angle. This special angle enables the plugging device 100 to plug and unplug from the second vent 50 more easily. Also, as mentioned above, an adhesive 62 is used to attach the plugging device 100 to the active shaft 40, so that when the active shaft 40 is pushed upward by the press board 36, the plugging device 100 moves upward with the active shaft 40 to unplug the second vent 50. The active shaft 40 and the plugging device 100 are made of metal. The adhesive can be a solder 62 that fixes the plugging device 100 onto the active shaft 40. Regardless of whether the present invention utilizes solder or another standard adhesive, of key importance is that the air bag 32 moves the active shaft 40 when the air bag 32 expands to a predetermined degree because of ink consumption, or rising external air pressure. The plugging device 100 is pulled from the second vent 50 by the active shaft 40, enabling external air to enter into the ink reservoir 20.

Figure 5:
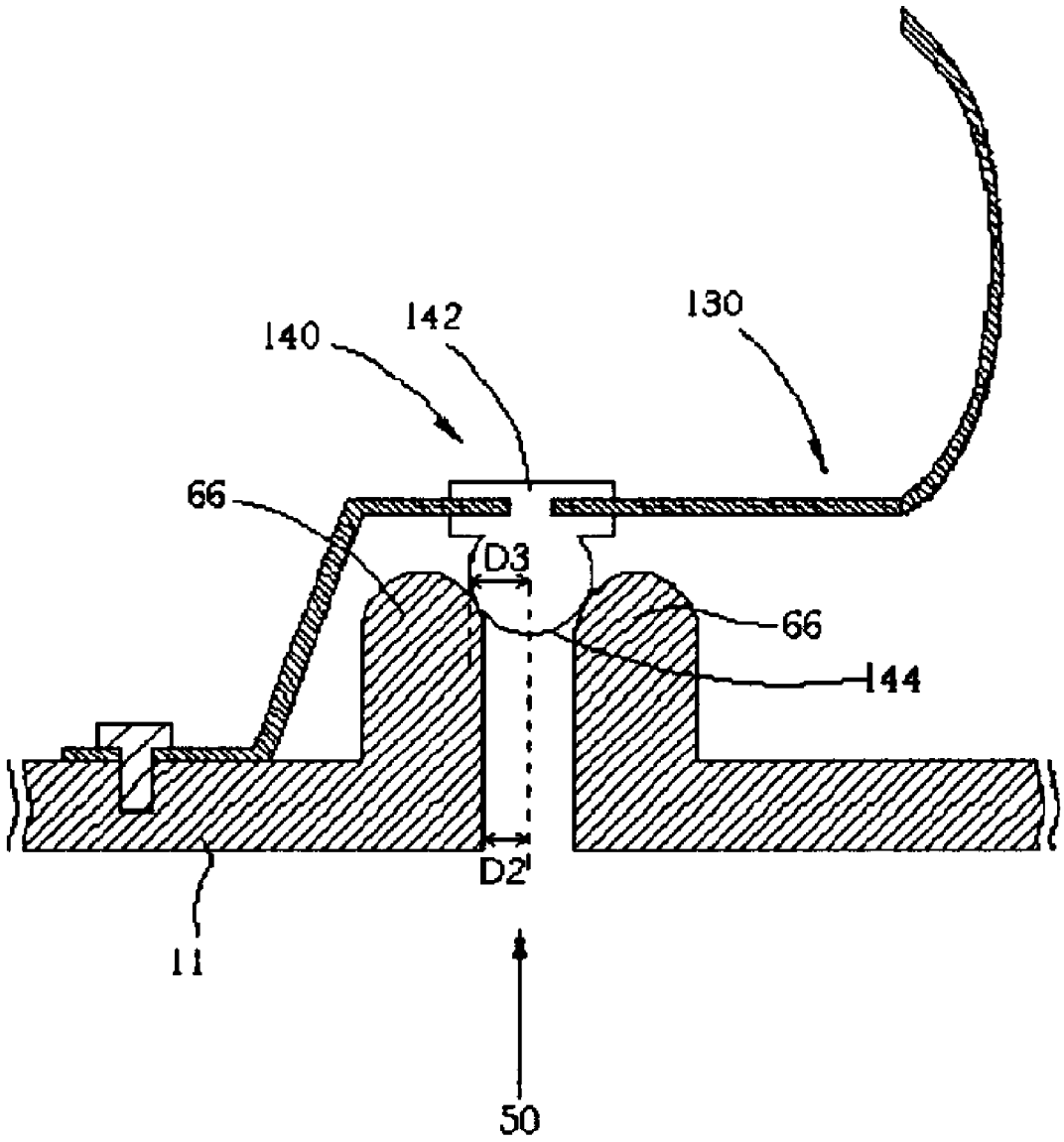
FIG. 5 is a diagram of an active shaft and plugging device for an alternative embodiment present invention ink jet cartridge.

Please refer to FIG. 5. FIG. 5 is a diagram of an active shaft 130 and a plugging device 140 of an alternate present invention ink reservoir 20. In this embodiment, the active shaft 130 comprises a device hole 142, and an end of the plugging device 140 is set in the device hole 142, so that the plugging device 140 is fixed on the active shaft 130. Furthermore, the plugging device 140 comprises an arc-shaped surface 144, with a radius of curvature of D3. As mentioned above, the second vent 50 is a round hole, and its radius is D2. The radius of curvature D3 of the arc-shaped surface 144 is larger than the radius D2 of the round hole, so the plugging device 140 is capable of plugging the second vent 50 by way of the arc-shaped surface 144. Similarly, the surface of the lip 66 and the arc-shaped surface 144 of the plugging device 140 meet at a special angle that permits the plugging device 140 to engage and disengage with the second vent 50 more easily.

The active shaft 130 and the plugging device 140 together form a complete structure to pull the plugging device 140 from the second vent 50 when the active shaft 130 is pushed upward.

In the comparison with the prior art, such as the bubble generator disclosed in U.S. Pat. No. 5,526,030, the present invention utilizes a mechanical controlling mechanism to control a vent to accept external air to maintain back-pressure in an ink reservoir. The controlling mechanism of the prior art, however, utilizes surface tension and static pressure of the ink column. The prior art structure is thus more complicated than that of the present invention, which increases the difficulty of producing the ink cartridge. Additionally, as noted before, when different types of ink are used, the surface tension of the ink may vary, and so the controlling mechanism needs to be redesigned. The present invention design, however, works independently of the type of ink used. The back-pressure controlling mechanism of the present invention ink reservoir 20 pushes on the active shaft 40 by way of the press board 36 due to expansion of the air bag 32. This causes the active shaft 40 to pull the plugging device 100 from the second vent 50, permitting external air to enter into the ink reservoir 20. The back-pressure controlling mechanism of the present invention ink reservoir 20 continues working normally until the ink is exhausted, and does not need to be redesigned for each type of ink. The structure of the back-pressure regulating mechanism of the present invention ink reservoir is simple and easy to produce, manufacture, and assemble.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An ink reservoir comprising:

a housing with an ink reservoir for storing ink, the housing having a first vent, a second vent, and an opening, the opening installed at a bottom end of the housing and connected to the ink reservoir;

an air bag installed in the ink reservoir and connected to the first vent, the first vent enabling external air to enter into the air bag, the air bag adjusting internal pressure within the ink reservoir;

an elastic constraining device installed in the ink reservoir for constraining air in the air bag to prevent the ink in the ink reservoir from leaking through the opening;

a plugging device for plugging the second vent of the housing; and an active shaft movably installed in the ink reservoir and connected to the plugging device for pulling the plugging device out of the second vent of the housing;

wherein comsumption of the ink in the ink reservoir causes the air bag to expand, and when the air bag expands to a predetermined degree, the air bag moves the active shaft, the active shaft pulls the plugging device out of the second vent, and air enters into the ink reservoir through the second vent to reduce the volume of the air bag, and when the air bag stops moving the active shaft, the active shaft returns to an original position and the plugging device plugs the second vent.

2. The ink reservoir of claim 1 wherein the plugging device is fixed on the active shaft.

3. The ink reservoir of claim 2 wherein the active shaft comprises a device hole, and an end of the plugging device is set in the device hole so that the plugging device is fixed on the active shaft.

4. The ink reservoir of claim 1 wherein the active shaft is an elastic element, and when the air bag expands to the predetermined degree, the air bag pushes the elastic element so that the elastic element pulls the plugging device out of the second vent, and when the air bag contracts, the elastic element returns to an original form and pushes the plugging device to the second vent to plug the second vent.

5. The ink reservoir of claim 1 wherein the plugging device has a spherical shape, the second vent is a round hole, and a radius of the plugging device is larger than a radius of the second vent so that the plugging device plugs the second vent.

6. The ink reservoir of claim 1 wherein the plugging device comprises an arc-shaped surface, the second vent is a round hole, and a radius of curvature of the arc-shaped surface is larger than a radius of the round hole so that the plugging device plugs the round hole.

7. The ink reservoir of claim 1 wherein the active shaft and the plugging device together form a monolithic structure.

8. The ink reservoir of claim 1 wherein an adhesive is used to adhere the plugging device to the active shaft.

9. The ink reservoir of claim 1 wherein the active shaft and the plugging device are made of metal, and the plugging device is welded onto the active shaft.

10. An ink reservoir comprising:

a housing with an ink reservoir for storing ink, the housing having a first vent and a second vent;

a print head installed at a bottom end of the housing and connected to the ink reservoir;

an air bag installed in the ink reservoir and connected to the first vent, the first vent enabling external air to enter into the air bag, the air bag adjusting internal pressure within the ink reservoir;

an elastic constraining device installed in the ink reservoir for constraining air in the air bag to prevent the ink in the ink reservoir from leaking through the print head;

a plugging device for plugging the second vent of the housing; and an active shaft movably installed in the ink reservoir and connected to the plugging device for pulling the plugging device out of the second vent of the housing;

wherein consumption of the ink in the ink reservoir causes the air bag to expand, and when the air bag expands to a predetermined degree, the air bag moves the active shaft, the active shaft pulls the plugging device out of the second vent, and air enters into the ink reservoir through the second vent to reduce the volume of the air bag, and when the air bag stops moving the active shaft, the active shaft returns to an original position and the plugging device plugs the second vent.

11. The ink reservoir of claim 10 wherein the plugging device is fixed on the active shaft.

12. The ink reservoir of claim 11 wherein the active shaft comprises a device hole, and an end of the plugging device is set in the device hole so that the plugging device is fixed on the active shaft.

13. The ink reservoir of claim 10 wherein the active shaft is an elastic element, and when the air bag expands to the predetermined degree, the air bag pushes the elastic element so that the elastic element pulls the plugging device out of the second vent, and when the air bag contracts, the elastic element returns to an original form and pushes the plugging device to the second vent to plug the second vent.

14. The ink reservoir of claim 10 wherein the plugging device has a spherical shape, the second vent is a round hole, and a radius of the plugging device is larger than a radius of the second vent so that the plugging device plugs the second vent.

15. The ink reservoir of claim 10 wherein the plugging device comprises an arc-shaped surface, the second vent is a round hole, and a radius of curvature of the arc-shaped surface is larger than a radius of the round hole so that the plugging device plugs the round hole.

16. The ink reservoir of claim 10 wherein the active shaft and the plugging device together form a monolithic structure.

17. The ink reservoir of claim 10 wherein an adhesive is used to adhere the plugging device to the active shaft.

18. The ink reservoir of claim 10 wherein the active shaft and the plugging device are made of metal, and the plugging device is welded onto the active shaft.

* * * * *